United States Patent [19]

Morrison

[11] Patent Number: 4,990,113

[45] Date of Patent: Feb. 5, 1991

[54] HAND GRIP FOR AEROBATIC MANEUVERS ON SURFBOARDS

[75] Inventor: Richard Q. Morrison, Calabasas, Calif.

[73] Assignee: Sexwax Incorporated, Carpinteria, Calif.

[21] Appl. No.: 311,687

[22] Filed: Feb. 16, 1989

[51] Int. Cl.[5] ..... A63C 15/06

[52] U.S. Cl. ..... 441/75

[58] Field of Search ..... 441/65, 74, 75; 114/39.2, 362

[56] References Cited

U.S. PATENT DOCUMENTS

| | | | |
|---|---|---|---|
| 3,604,031 | 9/1971 | Cahill | 441/65 |
| 4,604,070 | 8/1986 | McKee et al. | 441/75 |
| 4,619,619 | 10/1986 | Muse | 441/65 |
| 4,693,199 | 9/1987 | Omachen et al. | 441/75 |
| 4,775,345 | 10/1988 | Gifford | 441/75 |

FOREIGN PATENT DOCUMENTS

| | | | |
|---|---|---|---|
| 3331742 | 3/1985 | Fed. Rep. of Germany | 441/75 |
| 2178297 | 2/1987 | United Kingdom | 441/75 |

*Primary Examiner*—Sherman Basinger
*Assistant Examiner*—Stephen P. Avila
*Attorney, Agent, or Firm*—Donald D. Mon

[57] ABSTRACT

This invention is a hand grip provided with two spaced apart mounting pads for adhesive mounting to the surface of a surfboard. A strap extends between the mounts, and the mounts normally space the strap from the board surface. The strap is flexible and has limited elasticity.

2 Claims, 1 Drawing Sheet

HAND GRIP FOR AEROBATIC MANEUVERS ON SURFBOARDS

FIELD OF THE INVENTION

This invention relates to hand grips applied to surfboards for use during aerobatic maneuvers on surfboards.

BACKGROUND OF THE INVENTION

The conventional use of a surfboard involves sitting or laying on the board while waiting for a wave, accelerating the board while catching the wave, generally occupying a kneeling or laying down position while doing so, and then standing freely on the board during the ride. Such control as the rider exerts is the consequence of his changing his stance and the location of his feet on the board to steer it along the face of the wave. Often there is no interconnection between the rider and the board. At the most, a leash may be attached to his leg and to the board to lessen his efforts in retrieving the board when he falls off of it.

These maneuvers are all spectacular enough, and provide risk and thrills enough for most riders. However, skills have now been developed in which actual aerobatics are performed during the ride. By this term is meant that the rider and his board leave the water and perform inversions such as turns and loops. This is a spectacular display of both artistry and skill, especially since the rider and the board must move as a single unit, without effective interconnection between them.

This relative "looseness" of rider and board constitutes a limitation on the class of maneuvers that can be undertaken. Some acceptable means to interlink the two would enable a much broader scope of aerobatic maneuvers.

But there is a limitation on this objective. A surfboard must be sat on, laid on, stood on, and ridden on without substantial impediment. A large bulky handle, for example, would be too much in the way. To be acceptable, a grip must have a low profile, be readily grasped, and generally be out of the way. Further, it should be attachable to the board by convenient means which do not require drilling or otherwise defacing the board.

This invention provides a suitable grip for these purposes.

BRIEF DESCRIPTION OF THE INVENTION

This invention is a hand grip provided with two spaced apart mounting pads for adhesive mounting to the surface of a surfboard. A strap extends between the mount, and the mounts normally space the strap from the surface of the board. The strap is flexible and has limited elasticity. Thus unless defected from a normal position, there is a spacing between it and the bond through which the rider can readily pass his fingers.

The strap has limited flexibility and elasticity. When the rider lays or stands on it, mostly the strap can be flexed down to approach or lay against the board, thereby constituting a lesser surface irregularity. Also, when the rider pulls up on the strap, it has sufficient flexibility and elasticity to accommodate limited movement of the rider's hand.

The invention also comprehends the combination of the board and the hand grip, the hand grip being attached to the board between where the rider will usually place his feet. Then a pull on the grip will link his body to the board through his feet.

The above and other features of this invention will be fully understood from the following detailed description and the accompanying drawings, in which:

DETAILED DESCRIPTION OF THE INVENTION

Figure 1:
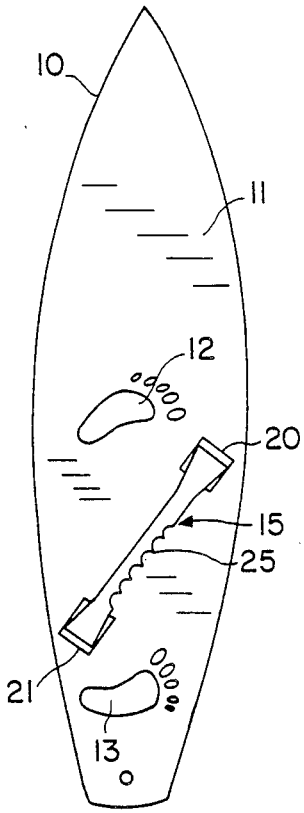
FIG. 1 is a plan view of a surfboard showing a hand grip according the invention mounted to it.

FIG. 1 shows a typical surfboard 10 having an upper surface 11 on which the rider rests or stands. Foot locations 12,13 schematically show the places where a rider usually places his feet during aerobatic maneuvers. Of course the individual may choose different places, but these are representative.

Figure 2:
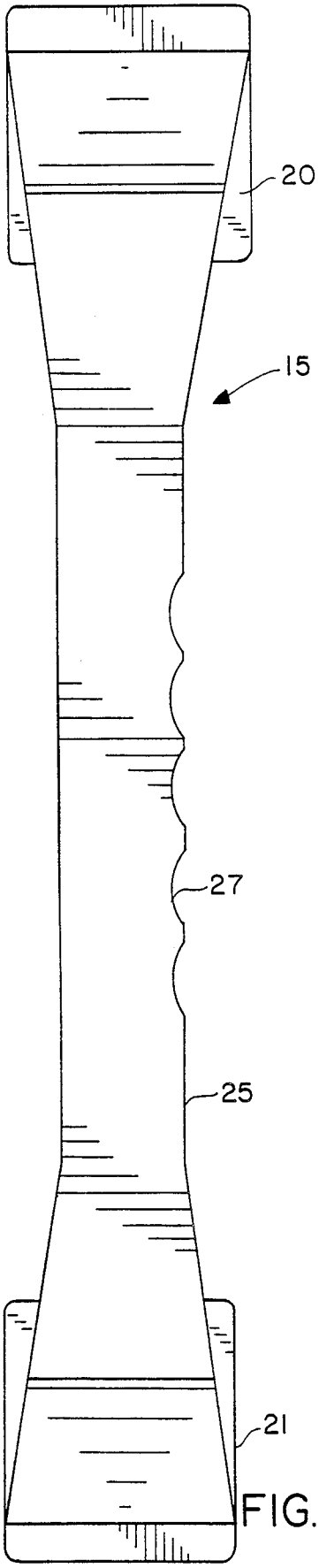
FIG. 2 is an enlarged top view of the hand grip.
Figure 3:
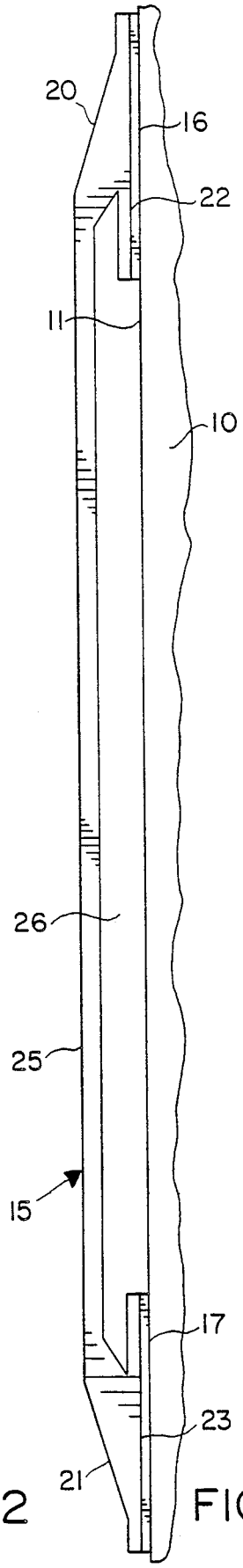
FIG. 3 is a side view of FIG. 2.

A hand grip 15 according to this invention is attached to surface 11 between locations 12 and 13. As shown in FIG. 3, an adhesive layer 16,17 between surface 11 and the grip is the preferred means of attachment. The adhesive can be a settable type or even double faced contact adhesive tape, as preferred. The board need not be pierced.

The grip includes mounts 20, 21 with mounting surfaces 22,23 that are brought to bear against surface 11. While fasteners could be used instead of adhesives, surfboard owners are understandably reluctant to cut or drill into their board. For this reason surfaces 22 and 23 provide sufficient area for a reliable adhesive joinder to be made.

A strap 25 extends between the mounts. The mounts space the strap from surface 11 so there is an opening 26 through which the rider's fingers can readily be passed. About 5/16" is adequate as a convenience, an edge of the strap can be grooved by grooves 27 to provide a better grip for the fingers.

Strap 25 is preferably made of a stiffly flexible material. Its free length between mounts is preferably about $11\frac{1}{2}$ inches, and its thickness about $\frac{1}{4}$". Deflection at its center of about 5/16" can readily be accommodated, so that when the strap is stepped on, it will readily deflect against surface 11. Thus except for the mounts themselves, which are rather small, the grip can be pressed down into a rather low-profile configuration.

However, the strap must also enable the rider to exert a strong pull both to keep the system interlinked, and to provide some guidance. For this reason also, the strap is stiffly elastic as well as flexible. A maximum deflection of perhaps one inch at the center of the strap is usually enough.

A reinforcement of randomly-laid fibers in the strap material can add strength to the strap while not unduly reducing its elasticity. Latex is a suitable material of construction for the strap. Organic plastic materials of suitable properties could also or instead be used.

Thus this hand grip can be adhered to a surfboard to serve as an interlinking means between the rider and the board, enabling him to perform aerobatic maneuvers with greater assurance.

This invention is not to be limited by the embodiment shown in the drawings and described in the description which is given by way of example and not of limitation, but only in accordance with the scope of the appended claims.

I claim:

1. A hand grip for a surfboard comprising: a unitary structure with a pair of spaced apart mounts, each mount having a flat mounting surface to be adhered to a surface of a surfboard, and a strap permanently fixed to and extending between said mounts, said mounts spacing said strap from said board when attached to said board to give ready access for the fingers of a rider, said strap having limited flexibility and elasticity such that at least its central position can be pressed against the surfboard surface when the rider lays on it, and can be pulled away from the said surface by a limited distance to facilitate gripping the hand grip and guiding the board while the rider stands on the board, maintaining his position relative to the board by pulling on the strap so as to hold his feet against said surface, said strap being generally parallel to the surface of said board during active use, said strap widening toward said mounts, and including grooves for improved gripping.

2. In combination:

a hand grip according to claim 1 and a surfboard having said surface, said mounting surfaces being adhesively adhered to said surfboard surface.

* * * * *